US006946072B2

(12) United States Patent
Ekholm et al.

(10) Patent No.: US 6,946,072 B2
(45) Date of Patent: Sep. 20, 2005

(54) METHOD AND APPARATUS FOR WASHING A FIBRE SUSPENSION

(75) Inventors: Rolf Ekholm, Karlstad (SE); Peter Wigarthsson, Kil (SE)

(73) Assignee: Kvaerner Pulping AB, Karlstad (SE)

( * ) Notice: Subject to any disclaimer, the term of this patent is extended or adjusted under 35 U.S.C. 154(b) by 211 days.

(21) Appl. No.: 10/399,972

(22) PCT Filed: Oct. 23, 2001

(86) PCT No.: PCT/SE01/02296

§ 371 (c)(1),
(2), (4) Date: May 22, 2003

(87) PCT Pub. No.: WO02/34999

PCT Pub. Date: May 2, 2002

(65) Prior Publication Data

US 2004/0040678 A1 Mar. 4, 2004

(30) Foreign Application Priority Data

Oct. 25, 2000 (SE) ..... 0003856

(51) Int. Cl.[7] ..... B01D 21/26; D21C 9/02

(52) U.S. Cl. ..... 210/512.1; 210/96.1; 210/512.3; 210/772; 210/787; 210/788; 162/18; 162/57; 162/60; 100/73; 100/74; 100/117; 100/145

(58) Field of Search ..... 210/772, 787, 210/788, 96.1, 512.1, 512.3; 162/18, 57, 60; 100/73, 74, 75, 117, 145

(56) References Cited

U.S. PATENT DOCUMENTS

| | | | | | |
|---|---|---|---|---|---|
| 3,964,996 | A | * | 6/1976 | Holz et al. | 209/17 |
| 4,286,512 | A | * | 9/1981 | Berggren | 100/74 |
| 4,915,830 | A | * | 4/1990 | Mackay et al. | 210/209 |
| 5,131,544 | A | | 7/1992 | Serres et al. | |
| 5,204,009 | A | * | 4/1993 | Rowland | 210/772 |
| 5,221,434 | A | * | 6/1993 | Henricson | 162/52 |
| 5,556,508 | A | | 9/1996 | Ekholm et al. | |
| 6,068,772 | A | * | 5/2000 | Czerwoniak et al. | 210/512.3 |
| 6,071,378 | A | * | 6/2000 | Saito | 162/58 |
| 2004/0040678 | A1 | * | 3/2004 | Ekholm et al. | 162/60 |

* cited by examiner

*Primary Examiner*—Robert James Popovics
(74) *Attorney, Agent, or Firm*—Nixon & Vanderhye P.C.

(57) ABSTRACT

A method for washing a fibre suspension with washing liquid, in which, in accordance with the invention, the fibre suspension is introduced into an annular treatment channel (24) that has an inlet end (72) and an outlet end (73) and is concentric with an axis of rotation (5) to form an inner annular layer (74), washing liquid simultaneously being introduced into the treatment channel form an outer layer (75), which surrounds the inner annular layer. The fibre suspension and washing liquid are caused to rotate in the treatment channel whilst moving from said inlet end to said outlet end, fibres in the fibre suspension being caused to move into the outer layer of washing liquid, under the influence of the centripetal force, so that an accept (29), the liquid phase of which completely or mostly consists of washing liquid, is discharged at the outlet end of the treatment channel.

16 Claims, 4 Drawing Sheets

III
II
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
72
73
74
75

5
6
16
17
23
49

11
12
13
15
37

METHOD AND APPARATUS FOR WASHING A FIBRE SUSPENSION

This application is the U.S. national phase of International Application No. PCT/SE01/02296 filed October 23, 2001, which designed the U.S.

The present invention relates to a method for continuously washing a fibre suspension with washing liquid.

The invention also relates to an apparatus for continuous washing of a fibre suspension with washing liquid, comprising

- an elongate rotor unit that is rotatably journalled to rotate about an axis of rotation in a pre-determined direction,
- an inlet section having
  - an inlet for the fibre suspension and
  - an inlet for a washing liquid,
- an outlet section having
  - an outlet for the accept and
  - at least one outlet for the reject, and
- a treatment section, comprising
  - an annular, elongate treatment channel for the fibre suspension, having an inlet end and an outlet end and being defined by
    - a first, inner wall element that forms part of the rotor unit and is concentric with the axis of rotation and
    - a second, outer wall element that is concentric with the axis of rotation and located radially outside the first, inner wall element.

U.S. Pat. No. 5,556,508 describes an apparatus for treating a fibre suspension that is fed into a displacement space, the outer limitation wall of which is rotatable and perforated to allow the washing liquid to be pressed through the limitation wall into the displacement space. The reject, that is the liquid displaced by the washing liquid, is drawn off by means of a channel located radially inside the displacement space. Thus, the washing liquid must be added with a significantly high pressure to be able to be pressed through the perforated wall into the displacement space and the fibre suspension added thereto, which offers powerful resistance, as fibres will be pressed against the inside of the perforated wall because of the rotation and form a thickened fibre mat blocking the openings in the perforated wall. In such an apparatus, there is a great risk of the fibre suspension being thickened in certain locations in the system of channels, with accompanying clogging and stoppages. In addition, there is a great risk of the washing liquid added under high pressure being pressed through said fibre mat in the locations where it presents less resistance so that channels are formed and the displacement effect is significantly impaired or ceases completely. Accordingly, the known washing apparatus has a relatively low degree of efficiency.

The object of the present invention is to provide a new method and a new apparatus for washing a fibre suspension that at least significantly reduces the above-mentioned problems.

The method in accordance with the invention is characterized in that

- the fibre suspension is fed into an annular, elongate treatment channel that has an inlet end and an outlet end and is concentric with an axis of rotation to form an inner annular layer,
- washing liquid is simultaneously fed into the treatment channel to form an outer annular layer that surrounds and is in direct physical contact with said inner annular layer,
- the fibre suspension and the washing liquid are caused to rotate about the axis of rotation while moving from said inlet end to said outlet end, and

- fibres in the fibre suspension, under the influence of the centripetal force, are caused to move in the direction towards and into said outer layer of washing liquid so that an accept, the liquid phase of which completely or mostly consists of washing liquid, is discharged at the outlet end of the treatment channel.

The apparatus in accordance with the invention is characterized in

- that the inner and outer wall elements of the treatment channel are impermeable to liquid,
- that the treatment channel is free of constructional elements between its inner and outer wall elements,
- that the inlet section has
  - an inlet channel, into which said inlet for the fibre suspension discharges, and which is concentric with the axis of rotation and is annular, at least in the part closest to the treatment channel, and
  - an annular inlet channel, into which said inlet for washing liquid discharges, and which is concentric with the axis of rotation and is located radially outside the inlet channel for the fibre suspension, the inlet channels being arranged to discharge into the treatment channel at its inlet end radially outside and adjacent to each other, so that an inner annular layer of fibre suspension and an outer annular layer of washing liquid that surrounds and is in direct physical contact with the layer of fibre suspension are formed in the treatment channel, and
- that the rotor unit is provided with a plurality of impeller vanes, arranged to cause the fibre suspension and the washing liquid to rotate about the axis of rotation so that fibres in the fibre suspension move towards and into the outer layer of washing liquid under the influence of the centripetal force.

The invention will be further described with reference to the accompanying drawings.

Figure 1:
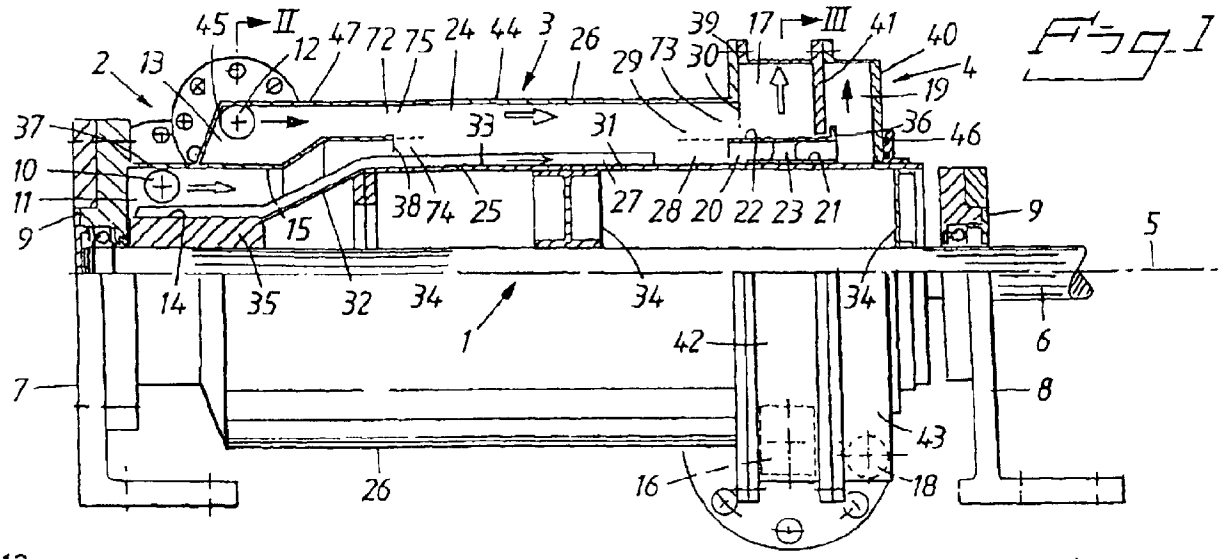
FIG. 1 shows, schematically, in side view and partly in section an apparatus for washing a fibre suspension in accordance with a first embodiment of the invention.

In the drawings, white arrows indicate flows of fibre suspension and black arrows flows of liquid.

Figure 3:
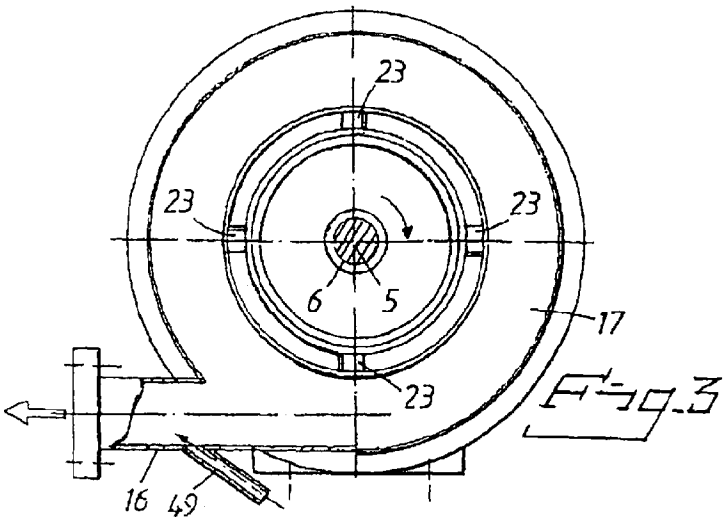
FIG. 3 is a cross section of the apparatus in FIG. 1 along the line III—III.
Figure 2:
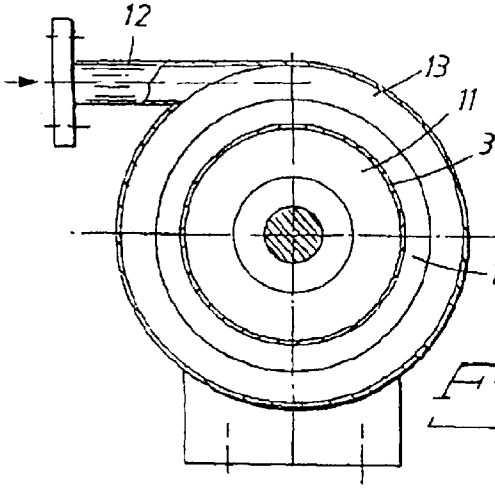
FIG. 2 is a cross section of the apparatus in FIG. 1 along the line II—II.

FIGS. 1–3 show an apparatus for treatment of a fibre suspension or pulp and, more particularly, for washing of the pulp. The apparatus comprises an elongate rotor unit 1, an inlet section 2, a treatment section 3 and an outlet section 4.

The rotor unit 1 is rotatably journalled to rotate about an axis of rotation 5, defined by an elongate shaft 6 that extends through the three sections 2, 3, 4. The apparatus has a stand, including two floor supports 7, 8, spaced from each other and located axially outside the inlet section 2 and the outlet section 4, respectively. The shaft 6, which is driven by a motor (not shown), is rotatably journalled in bearing members 9 at the ends of the apparatus.

The inlet section 2 has an inlet 10 for pulp, connecting tangentially to an inner, elongate, concentric, annular inlet channel 11, and a similar inlet 12 for washing liquid, connecting tangentially to an outer, elongate, concentric, annular inlet channel 13, the inlet 12 for washing liquid being arranged radially outside the pulp inlet 10 and axially somewhat displaced relative to the same. The inlet channel 11 is defined by a first, inner wall element 14, which forms part of the rotor unit 1 and which thus is rotatable. The inner wall element 14 is concentric with the axis of rotation 5 and is located a pre-determined minimum distance from the same, which distance increases in the direction of flow, as is evident from FIG. 1. The inlet channel 11 is further defined by a second, outer wall element 15, concentric with the axis of rotation 5 and located radially outside the inner wall element 14. The inlet channel 13 is defined by an inner wall element, formed by said wall element 15 and an outer wall element 47.

The outlet section 4 has an outlet 16 for the accept and a first, concentric, annular outlet channel 17, to which the accept outlet 16 connects tangentially, and a similar outlet 18 for the reject and a second, concentric, annular outlet channel 19, to which the reject outlet 18 connects tangentially. The outlet channels 17, 19 are arranged axially adjacent to each other. The outlet channel 19 for the reject is in communication with the treatment section 3 via an axial, concentric, annular connection channel 20, which thus is located radially inside said outlet channel 17 for the accept. The connection channel 20 is defined by inner and outer wall elements 21, 22 that both form part of the rotor unit 1 and are concentric with the axis of rotation 5, the outer wall element 22 being supported by the inner wall element 21 by means of a plurality of radial support elements 23, which are inclined in the direction of flow to exert an axial feeding effect on the reject. The connection channel 20 has a pre-determined radial extension, i.e. the difference in radius between wall elements 21 and 22.

The treatment section 3 has an annular, concentric treatment channel 24 that has a pre-determined, long extension and is provided with an inlet end 72 and an outlet end 73. The treatment channel 24 is in direct, open communication with said channels 11, 13 and 17, 19, 20 of the inlet and outlet sections 2, 4, respectively, via these inlet and outlet ends 72, 73. In other words, there are no flow-impeding or flow-limiting, screen-like or perforated construction elements in the transitions between the channels at said inlet and outlet ends 72, 73, nor in the actual channels. The treatment channel 24 is defined by a first, inner, wall element 25 that is impermeable to liquid and forms part of the rotor unit 1. The inner wall element 25 is concentric with the axis of rotation 5 and located a pre-determined constant distance from the same. The treatment channel 24 is further defined by a second, outer, wall element 26 that is impermeable to liquid, concentric with the axis of rotation 5 and located radially outside the inner wall element 25. As mentioned above, the inlet channels 11, 13 discharge directly into the treatment channel 24 via its inlet end 72, the inlet channels 11, 13 being arranged to discharge into the treatment channel 24 radially outside and adjacent to each other so that they are in contact with each other. The inner wall element 25 is provided with a plurality of impeller vanes 27, which thus are located in the treatment channel 24 to cause the content, consisting of fibres and liquid, to rotate about the axis of rotation 5 in a helical movement path during its passage through the treatment channel 24. As the treatment channel 24 is free from any kind of flow-impeding or flow-limiting construction element, such as screen elements, for instance, the fibres in the fed-in pulp have complete freedom, during rotation in the treatment channel under the influence of the centripetal force, to move within and out of the liquid phase of the pulp in the direction away from the inner wall element 25 to form an inner, annular, aqueous layer 28, having low fibre content, and an outer, annular, aqueous layer 29, having high fibre content. As the object is to separate the inner liquid layer 28 of low fibre content, the reject, from the outer layer 29 of high fibre content, the accept, the connection channel 20 is thus dimensioned for the reject so that its radial extension corresponds to the radial extension, that is the thickness, of the liquid layer 28 of low fibre content as measured in close proximity to the connection channel 20, that is at the outlet end 73 of the treatment channel 24 where its thickness for natural reasons is greatest. Thus, the liquid layer 28 of low fibre content is removed via the first, inner connection channel 20 for reject, whilst the aqueous layer 29 of high fibre content is discharged via a second, outer connection channel 30. The inner wall element 14 of the inlet channel 11 is likewise provided with impeller vanes (omitted in FIG. 2), which constitute extensions of the impeller vanes 27. Similar impeller vanes can also be arranged on the inner wall element 15 of the inlet channel 13.

In the embodiment shown in FIGS. 1–3, the rotor unit 1 is made up of a casing 31, consisting of a conical casing part 32, facing the inlet section 2, and a cylindrical casing part 33, joined to the conical casing part 32 and extending through the treatment section 3 and the outlet section 4. The casing 31 is rigidly connected to the shaft 6 via a plurality of mounting elements, comprising a plurality of support rings 34, within the extension zone of the casing 31, and a support ring 35, which is located within the inlet section 2 and to which the casing 31 is rigidly attached by its conical casing part 32. The casing 31 is provided with said impeller vanes 27. In the embodiment shown, the cylindrical casing part 33 has a constant circular cross section. Further, a ring element 36 is rigidly mounted on the outside of the casing 31 within the outlet section 4. Accordingly, said inner wall elements 14, 25, 21 are formed by said support ring 35, casing 31, and ring element 36.

The inlet section 2 comprises a concentric, tubular body 37, one end of which is rigidly mounted, for instance by welding, to the nearby bearing member 9 of the floor support 7, whilst the other end is free so that a free, radially expanded end portion surrounds the conical casing part 32 and a small portion of the cylindrical casing part 33 and so that said free end and the opposing cylindrical casing part 33 define between them an annular free opening 38. Said pulp inlet 10 connects tangentially to this tubular body 37, which thus forms said outer wall element 15 of the inlet section 2.

The outlet section 4 comprises an inner, an outer and an intermediate, flat ring 39, 40 and 41, respectively. The inner ring 39 and the intermediate ring 41 define between them said outlet channel 17 for the accept, whilst the outer ring 40 and the intermediate ring 41 define between them said outlet channel 19 for the reject. Cylindrical walls 42, 43 are rigidly attached to the three said flat rings 39, 40, 41 to define circumferentially said outlet channels 17 and 19, respectively.

A cylindrical, outer casing 44 with a constant circular cross section is rigidly attached by one of its ends to the inner, flat ring 39 of the outlet section 4 and by its other end to an end plate 45, which in turn is rigidly mounted to the tubular body 37 of the inlet section 2. Thus, the casing 44 forms said outer wall elements 47 and 26 of the outer inlet channel 13 and the treatment channel 24, respectively. In the embodiment shown in FIG. 1, the casing 44, the flat rings 39, 40, 41, the cylindrical walls 42, 43, the end plate 45 and the tubular body 37 form a stationary unit or stator unit, the rotor unit 1 being in sliding and sealing contact with the stator unit by means of an annular slide and sealing device 46, arranged at the outer flat ring 40. In the embodiment shown in FIG. 1, the treatment channel 24 has a constant, through-flow area.

As previously mentioned, the washing-liquid inlet 12 is located a radial distance from the shaft 6 greater than that of the pulp inlet 10 and adjacent to the cylindrical casing 44 of the stator unit, so that the washing liquid in the subsequent inlet channel 13 will follow the inside of the casing 44 and the outside of the wall element 15, around the same in a helical path and, accordingly, with an axial movement component in the direction towards and into the treatment channel 24, to form an outer annular layer 75 of washing liquid at the inlet end 72 of the treatment channel 24. The pulp simultaneously flowing into the inlet channel 11 follows the inside of the wall element 15 and the outside of the wall element 14 around the same in a helical path and, accordingly, with an axial movement component in the direction towards and into the treatment channel 24, via the opening 38, to form an inner annular layer 74 of pulp at the inlet end 72 of the treatment channel, which pulp layer 74 encounters the washing-liquid layer 75 without the layers 74, 75 mixing with each other with the exception of the boundary zone between them. The rotor unit 1 will influence the pulp layer 74 to continue rotating in a movement path about the axis of rotation 5 and, as the outlets 16, 18 are open for continuous discharge, the movement path will be helical. As the pulp layer 74 is in direct physical contact with the washing-liquid layer 75 located radially outside it, the pulp layer 74 will influence the washing-liquid layer 75 so that this likewise moves in its above-mentioned helical path with the same incline, that is with the same movement component towards the outlet, possibly disregarding a small zone adjacent to the inside of the casing 44 due to the friction between the same and the liquid. Due to the fact that a fibre is heavier (approximately 5 per cent heavier) than the corresponding volume of liquid, the fibre will be influenced by the centripetal force so that it moves in the direction towards the casing 44 of the stator unit to be received by the washing-liquid layer 75, which thereby obtains an increasing fibre content in the direction towards the outlet end 73, whilst the pulp layer 74 simultaneously obtains a corresponding diminishing fibre content, so that said reject layer 28 is formed in proximity to the outlet end 73 to be removed from the apparatus via the connection channel 20, the outlet channel 19 and the reject outlet 18. The washing liquid now forms the liquid phase of the simultaneously obtained accept layer 29. In other words, the fibres have been moved radially outwards from an inner, unclean liquid phase to an outer, cleaner or fresh liquid phase, depending on the quality of the washing liquid.

As the outer casing 44 is stationary, one or more helical vanes can be arranged on the inside of the casing 44, which helical vanes extend in a helix, like a thread, from the upstream end of the casing to its downstream end. Such a helical vane, which can have a height of 2 mm, assists in feeding the material towards the outlet section. The outlet 16 for the accept is provided with a supply pipe 48 for diluting liquid (see FIG. 3) to enable or facilitate pumping of the accept, depending on its consistency.

If so desired, the outer casing 44, comprising the outer wall elements 26, 47, can be made to rotate together with the inner casing 31, i.e. to form part of the rotor unit 1 by means of connection pieces, similar to the support elements 23, being arranged between the casings 31, 44, and slide and sealing devices being arranged between the thus movable, outer casing and the opposing fixed construction elements at the movable, outer casing.

The washing-liquid inlet 12 in the apparatus shown in FIG. 1 can include a stop device to shut off the supply of washing liquid, if so desired, in which case the apparatus will act as a thickener.

The apparatus in accordance with FIG. 1 can be operated with a rotational speed within the range of 100–3000 revolutions per minutes. The inner casing 31 can have a diameter D within the range of 300–3000 mm, the length of the washing zone, that is the treatment channel 24, being selected within the range 1×D–15×D. By means of the inlets 10, 12 being aimed tangentially at the annular inlet channels 11, 13, the pump energy of the pulp and the washing liquid is utilized and the movement of the pulp and the washing liquid is transformed from a straight to a rotary movement, which is then maintained by the impeller vanes 27. The inlets 10, 12 are placed a radial distance from the axis of rotation 5 such that the pulp and the washing liquid, respectively, enter with speeds in each case adapted to the selected rotational speed so that no significant reductions in speed occur.

Figure 4:
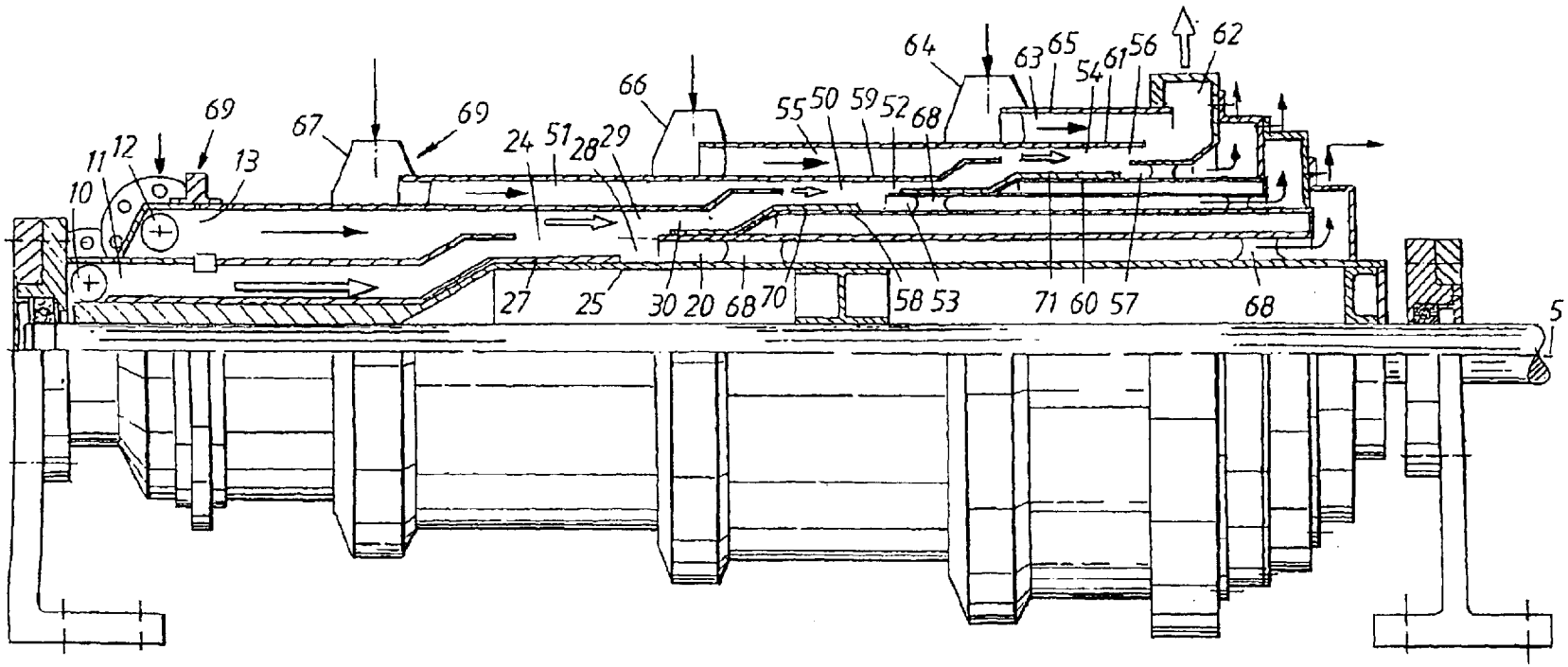
FIG. 4 shows, schematically, in side view and partly in section an apparatus for washing a fibre suspension in several steps in accordance with a second embodiment of the invention.

FIG. 4 shows an apparatus in accordance with a second embodiment of the invention, which has the same basic design as the one shown in FIG. 1 but is designed for washing in several steps. Thus, the apparatus in FIG. 4 is a multi-stage washer, having a first treatment channel 24 with inlet channels 11, 13 for pulp and washing liquid, respectively, and axial connection channels 20, 30 for accept and reject, respectively, in accordance with the apparatus in FIG. 1, save for their axial extension. The first treatment channel 24 is thus followed by a second treatment channel 50 with inlet channels 30, 51 for pulp and washing liquid, respectively, and axial connection channels 52, 53 for accept and reject, respectively, and thereafter a third treatment channel 54 with inlet channels 53, 55 for pulp and washing liquid, respectively, and axial connection channels 56, 57 for accept and reject, respectively. The second and third treatment channels 50, 54 are defined by inner and outer concentric wall elements 58, 59; 60, 61 in the same way as with the first treatment channel 24. The accept leaving the third treatment channel 54 is diluted with diluting liquid, added to an outlet channel 62 via an annular connection channel 63, which is connected to an annular inlet house 64 and defined by an outer wall element 65 and the outer wall element 61 of the third treatment channel 54. The inlet channels 51, 55 for washing liquid for the two additional treatment channels 50, 54 are in communication with annular peripheral inlet houses 66, 67. The washing liquid for the third treatment channel 54 consists of fresh water, whilst the washing liquid for the second treatment channel 50 consists of the reject from the third treatment channel 54. The washing liquid for the first treatment channel 24 consists of the reject from the second treatment channel 50. Said wall elements are connected to each other via axially extending connection pieces 68 and, accordingly, form part of the rotor unit 1 to rotate about the axis of rotation 5. Slide and sealing devices 69 of different kinds are arranged where the wall elements connect with stationary construction elements in the multi-stage washer. Further, the inner wall element in each treatment channel 24, 50, 54 is provided with impeller vanes 27, 70 and 71, respectively, to maintain the rotation of the pulp and the washing liquid in the annular, axially extending treatment channel. The inner wall elements in the inlet channels 13, 51, 55 are likewise suitably provided with impeller vanes (not shown).

The treatment channels shown in FIGS. 1 and 4 are parallel to the axis of rotation 5 and their through-flow area is constant. In accordance with an alternative embodiment, the treatment channel is conical in that the outer wall element has been fashioned as a cone with its diameter increasing in the direction of flow, the through-flow area thus increasing in the direction towards the outlet.

Figure 5:
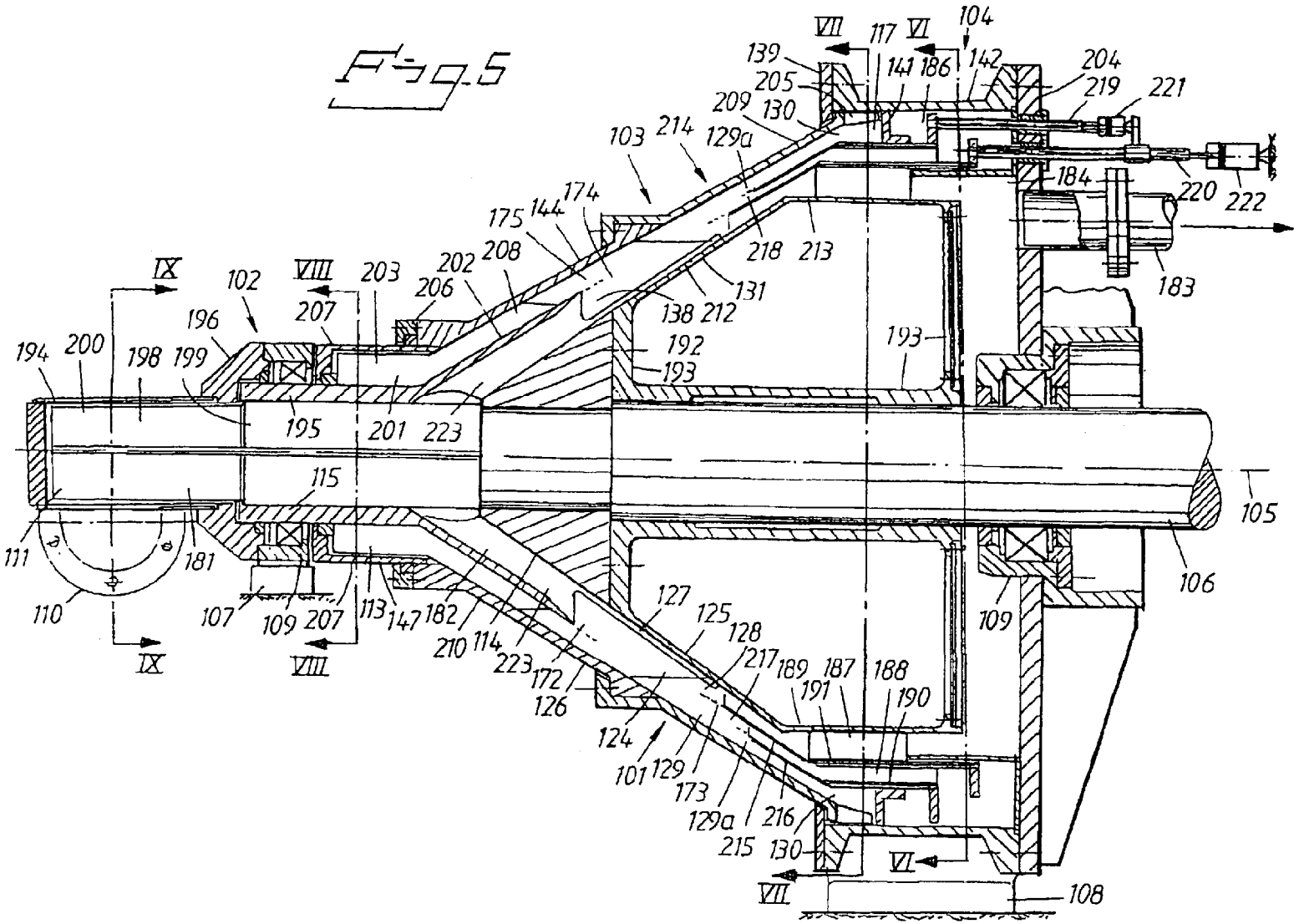
FIG. 5 shows, schematically, in side view and partly in section an apparatus for washing a fibre suspension in accordance with a third embodiment of the invention.

FIG. 5 shows an apparatus in accordance with a third embodiment of the invention for treatment of a fibre suspension or pulp and, more particularly, for washing the pulp. The apparatus comprises an elongate rotor unit 101, an inlet section 102, a treatment section 103 and an outlet section 104.

The rotor unit 101 is rotatably journalled to rotate about an axis of rotation 105, defined by an elongate shaft 106, extending throughout the outlet and treatment sections 104, 103 and partially into the inlet section 102. The apparatus has a stand, including two floor supports 107, 108, spaced from each other and located axially inside the inlet section 102 and the outlet section 104, respectively. Bearing members 109 for rotatably journalling the shaft 106, which is driven by a motor (not shown), are arranged at the ends of the apparatus.

Figure 8:
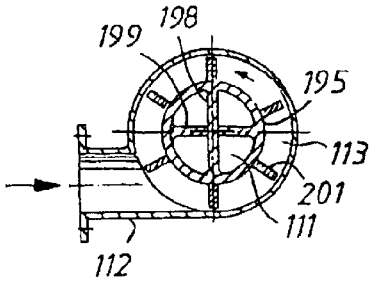
FIG. 8 is a cross section of the apparatus in FIG. 5 along the line VIII—VIII.

The inlet section 102 has an inlet 110 for pulp, which connects tangentially to an inner, elongate inlet channel 111, concentric with the axis of rotation 105 and a similar inlet 112 for washing liquid (see FIG. 8), which connects to an outer, elongate, concentric inlet channel 113, the inlet 112 for washing liquid being arranged radially outside the pulp inlet 110 and axially somewhat displaced relative to the same. The inlet channel 111 has an axial first part 181, coaxial with the axis of rotation 105, and a conical second part 182, in which the inlet channel 111 is defined by an inner wall element 114, which forms part of the rotor unit 101 and is thus rotatable. The inner wall element 114 is concentric with the axis of rotation 5 and has a certain conicity. The inlet channel ill is further defined by an outer cylindrical wall element 115, concentric with the axis of rotation 105. The inlet channel 113 likewise has an axial first part 203 and a conical second part 208. The inlet channel 113 is defined by an inner wall element, which is formed by said wall element 115 and a conical wall element 202, in one piece with the wall element 115. Further, the inlet channel 113 is defined by an outer wall element 147, formed by a concentric tube part 207 and a conical wall element 210.

Figure 6:
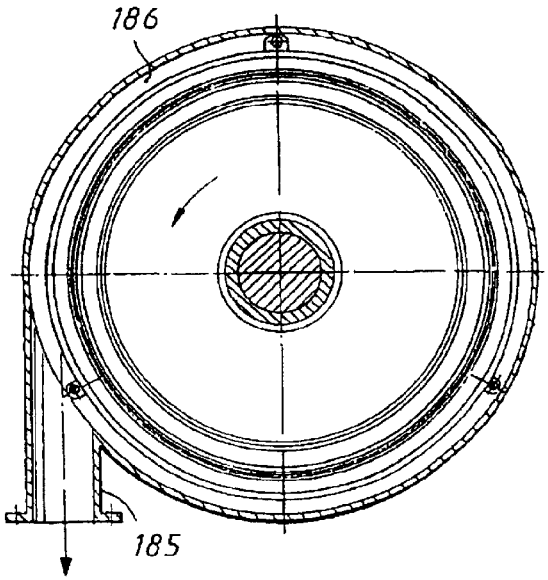
FIG. 6 is a cross section of the apparatus in FIG. 5 along the line VI—VI.
Figure 7:
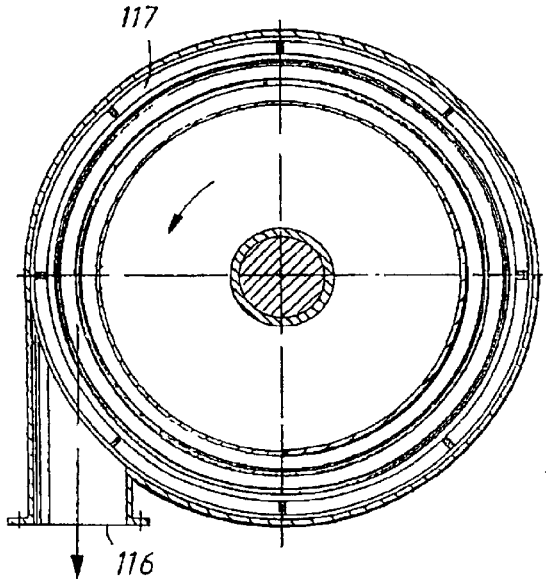
FIG. 7 is a cross section of the apparatus in FIG. 5 along the line VII—VII.

The outlet section 104 has an outlet 116 for the accept (see FIG. 7) and a concentric, annular outlet channel 117, to which the accept outlet 116 connects tangentially. The outlet section 104 further has a first outlet 183 for a first reject and a concentric, annular outlet channel 184, to which the reject outlet 183 connects axially, and a second outlet 185 for a second reject (see FIG. 6) and a concentric, annular outlet channel 186, to which the second reject outlet 185 connects tangentially. The outlet channels 117, 186 are arranged axially adjacent to each other. The outlet channels 184, 186 for the rejects communicate with the treatment section 103 via concentric, annular connection channels 187, 188, which thus are located radially inside said outlet channel 117 for the accept. The connection channels 187, 188 are defined by inner and outer wall elements 189, 190 and by an intermediary wall element 191, the inner wall element 189 forming a part of the rotor unit 101. All the wall elements 189, 190, 191 are concentric with the axis of rotation 5.

The treatment section 103 has an annular, concentric treatment channel 124 that has a pre-determined, elongate, conical extension and exhibits an inlet end 172 and an outlet end 173. The treatment channel 124 is in direct open communication with said channels 111, 113, and 117, 187, 188 of the inlet and outlet sections 102 and 104, respectively, via these inlet and outlet ends 172, 173. In other words, there are no flow-impeding or flow-limiting, screen-like or perforated construction elements in the transitions between the channels at said inlet and outlet ends 172, 173, nor in the actual channels. The treatment channel 124 is defined by a first, inner, conical wall element 125 that is impermeable to liquid and forms part of the rotor unit 101. The inner wall element 125 is concentric with the axis of rotation 105 and is located a pre-determined distance from the same, as measured at the inlet end 172. Further, the treatment channel 124 is defined by a second, outer, conical wall element 126 that is impermeable to liquid and concentric with the axis of rotation 105 and located radially outside the inner wall element 125. As mentioned above, the inlet channels 111, 113 discharge directly into the treatment channel 124 via its inlet end 172, the inlet channels 111, 113 being arranged to discharge into the treatment channel 124 radially outside each other and adjacent to each other so that they are in contact. The inner wall element 125 is provided with a plurality of impeller vanes 127, which thus are located in the treatment channel 124 to cause the content, which thus consist of liquid and fibres, to rotate about the axis of rotation 105 in a helical movement path during its passage through the treatment channel 124. As the treatment channel 124 is free from any kind of flow-impeding or flow-limiting construction elements, such as screen elements, for instance, the fibres in the fed-in pulp have complete freedom, during rotation in the treatment channel under the influence of the centripetal force, to move within and out of the liquid phase of the pulp in the direction away from the inner wall element 125 to form an inner, annular, aqueous layer 128, of low fibre content, and an outer, annular, aqueous layer 129, of high fibre content.

In the embodiment shown in FIG. 5, the rotor unit 101 is made up of a casing 131, consisting of a conical casing part 212 and a cylindrical casing part 213, joined to the conical casing part 212 and extending into the outlet section 104. The casing 131 is rigidly connected to the shaft 106 via a plurality of radial and axial attachment elements 193. Further, the rotor unit 101 has a conical body 192, rigidly connected to the adjacent radial attachment elements 193 of the casing 131 and comprising said conical wall element 114, which is aligned with the conical casing part 212. The casing part 212 is provided with said helical vanes 127.

Figure 9:
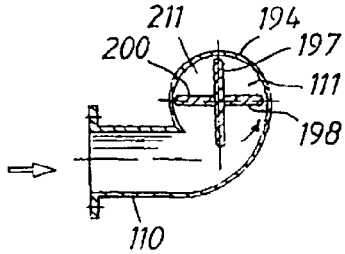
FIG. 9 is a cross section of the apparatus in FIG. 5 along the line IX—IX.

The coaxial first part 181 of the inlet channel 111 consists of a stationary tube 194 and a rotatable tube 195, tightly joined to the end of the stationary tube 194 via a stationary ring 196, in turn connected to the bearing members 109, which are arranged on the support 107 and in which the tube 195 is rotatably journalled. A rotor cross 198 has a first part 199, rigidly mounted inside the rotatable tube 195, and a second part 200, protruding from the fixed, first part 199 to be freely received by the stationary tube 194 for rotation inside the same. The rotor cross 198 has vanes 197 (see FIG. 9) that define between them axial channels 211, through which the pulp passes during the rotation of the rotor cross 198. Further, the rotatable tube 195 is provided on its outside with a plurality of impeller vanes 201, arranged to keep the washing liquid in rotation and extended into the conical second part 208 of the inlet channel 113, where the extended impeller vane parts are rigidly connected to the conical wall elements 202 and 210. The conical second part 182 of the inlet channel 111 is defined by said conical wall element 114 and the conical wall element 202, which is joined at one of its ends to the upstream rotatable tube 195, whilst the other end is free to define an annular opening 138 between it and the conical wall element 114. A plurality of impeller vanes 223, in the conical second part 182, are rigidly connected to the wall elements 114 and 202 and merge with the impeller vanes 127. The rotor cross 198 is with its inner end rigidly connected to the shaft 106 for joint rotation. Thus, the rotor cross 198 and the tube 195, with the impeller vanes 201, 223 and the wall element 202, form parts of the rotor unit.

The outlet section 104 comprises first and second rings 139 and 141, respectively, that define between them said outlet channel 117 for the accept. The second ring 141 and the end wall 204 define between them said outlet channel 186 for the second reject. The two flat rings 139, 141 and the end wall 204 are rigidly attached to a cylindrical wall 142, which circumferentially defines said outlet channels 117 and 186.

A conical, outer casing 144, having a diameter increasing in the direction of flow, is at its downstream end provided with an annular slide and sealing device 205, co-operating with said cylinder wall 142, and at its upstream end provided with an annular slide and sealing device 206, co-operating with said non-rotating tube part 207. The casing 144 is rigidly connected to the opposite inner casing 131 via the impeller vanes 201, 223 and the wall element 202, thus forming part of the rotor unit 101. The upstream portion of the casing 144 forms said outer wall element 210 in the inlet channel 113. Further, the casing 144 forms the outer wall element 126 in the treatment channel 124 and an outer wall element 209 in the connection channel 130. Both end portions of the apparatus form two stator units, between which the rotor unit 101 extends and to which the rotor unit is rotatably connected by means of said slide and sealing devices 205, 206. The treatment channel 124 has a constant through-flow area, as the casings 131 and 144 have different conicity. As previously mentioned, the washing-liquid inlet 112 is located a radial distance from the shaft 106 that is greater than that of the pulp inlet 110 (which is coaxial) and adjacent to the conical casing 144 of the rotor unit so that the washing liquid in the subsequent inlet channel 113 follows the inside of the casing 144 and the outside of the wall element 202 around these in a helical path and, accordingly, with a movement component in the direction towards and into the treatment channel 124 to form an outer annular layer 175 of washing liquid at the inlet end 172 of the treatment channel 124. The pulp, simultaneously flowing into the inlet channel 111, follows the inside of the wall element 115 and the outside of the wall element 114 in a helical path and, accordingly, with a movement component in the direction towards and into the treatment channel 124 to form an inner annular layer 174 of pulp at the inlet end 172 of the treatment channel 124, which pulp layer 174 encounters the washing-liquid layer 175 without the layers 174, 175 mixing with each other with the exception of the boundary zone between them. The rotor unit 101 will influence the pulp layer 174 to continue rotating in a movement path about the axis of rotation 105 and, as the outlets 116, 183 and 185 are open for continuous discharge, the movement path will be helical. As the pulp layer 174 is in direct physical contact with the layer 175 of washing liquid located radially outside it, the pulp layer 174 will influence the layer 175 of washing liquid so that this likewise moves in its above-mentioned helical path with the same incline, that is with the same movement component towards the outlet. Due to the fact that a fibre is heavier (approximately 5 per cent heavier) than the corresponding volume of liquid, the fibre will be influenced by the centripetal force so that it moves in the direction towards the outer casing 144 to be received by the washing-liquid layer 175, which thereby obtains an increasing fibre content in the direction towards the outlet end 173, whilst the pulp layer 174 simultaneously obtains a corresponding diminishing fibre content, so that said reject layer 128 is formed in proximity to the outlet end 173 to be removed from the apparatus via the connection channels 187, 188, the outlet channels 184, 186 and the reject outlets 183, 185. The washing liquid now forms the liquid phase of the simultaneously obtained accept layer 129. In other words, the fibres have been moved radially outwards from an inner, unclean liquid phase to an outer, cleaner or fresh liquid phase, depending on the quality of the washing liquid.

The outlet 116 for the accept can also in this case be provided with a supply pipe for diluting liquid, if so desired.

In an alternative embodiment (not shown) of the apparatus in accordance with FIG. 5, the outer casing 144 is rigidly mounted to the two non-rotatable terminal stator units to form a single stator unit, the impeller vanes 208 being rigidly connected only to the wall element 202 to pass around the inside of the wall element 210. In this case, one or more helical vanes can be arranged on the inside of the casing 144, which helical vane extends in a helix, like a thread, from the upstream end of the casing to its downstream end. Such a helical vane, which can have a height of 2 mm, assists in feeding the material towards the outlet section.

The apparatus shown in FIG. 5 further comprises a device for regulating the consistency of the accept. To that end, the apparatus comprises a transit section 214, which is located between the treatment section 103 and the outlet section 104 and which, in principle, is a constructional extension of the treatment section 103. The outer and intermediate wall elements 190, 191 comprise individual cylindrical plate parts, as well as individual conical partitions in the form of plate parts 215, 216, extending into the transit section 214, the connection channels 130, 187, 188 thus commencing with conical channel parts. The conical plate part 216 located furthest away from the axis of rotation 105 extends only partly into the transit section 214 so that an annular space 217 is formed between the free end portion of the conical plate part 215 located closest to the axis of rotation 105 and the outer wall element 209, which space 217 has a relatively short extension in the direction towards the outlet, for instance 10–50 cm. This space 217 forms a thickening zone, through which the accept from the treatment channel 124 passes while being thickened, the thickened, annular accept layer 129*a* thus obtained being fed through the connection channel 130 and the liquid layer 128 of low fibre content, which forms the second reject, through the connection channel 188. The first reject 128, obtained from the actual washing, is discharged through the connection channel 187. If the most important operating parameters are known, such as rotational speed, the consistency of the pulp, etc., the two plate parts 215, 216 can be rigidly mounted in pre-determined radial positions relative to each other and to adjacent wall elements, which positions are adapted to given operating conditions. However, it is preferred that the plate parts 215, 216 are movably arranged for setting said radial positions to adapt the apparatus to the prevailing operating conditions even during operation, if the operating parameters are changed or vary. The control device in FIG. 5 has an arrangement such that each wall element 190, 191 is connected to the piston rod 219, 220 of an externally arranged transmission device 221, 222, suitably a hydraulic device, the piston rods 219, 220 extending axially through the end wall 204. The perpendicular distance between the two conical plate parts 215, 216, and between these and nearby wall elements 125, 209 can thereby be changed and adjusted to achieve optimal operating conditions. In an alternative embodiment (not shown), said thickening zone is omitted, i.e. the control device comprises only one plate part, for instance the plate part 215 located closest to the axis of rotation 105, which plate part in that case is movable to be set so that the volumetric ratio between accept and reject is optimized.

In the above description and in the appended claims, the expression "annular" is used for a channel even if the channel has impeller vanes that completely or partially close the channel circumferentially. During operation, however, the material moves in the shape of a ring about the axis of rotation.

What is claimed is:

1. An apparatus for continuous washing of a fibre suspension with washing liquid, comprising an elongate rotor unit (1) that is rotatably journalled to rotate about an axis of rotation (5) in a pre-determined direction, an inlet section (2) having an inlet (10) for the fibre suspension and an inlet (12) for a washing liquid, an outlet section (4) having an outlet (16) for the accept and at least one outlet (18) for the reject, and a treatment section (3), comprising an annular, elongate treatment channel (24) for the fibre suspension, having an inlet end (72) and an outlet end (73) and being defined by a first, inner wall element (25) that forms part of the rotor unit (1) and is concentric with the axis of rotation (5) and a second, outer wall element (26) that is concentric with the axis of rotation (5) and located radially outside the first, inner wall element (25), wherein that the inner and outer wall elements (25, 26) of the treatment channel (24) are impermeable to liquid, that the treatment channel (24) is free of constructional elements between its inner and outer wall elements (25, 26), that the inlet section (2) has an inlet channel (11), into which said inlet (10) for the fibre suspension discharges, and which is concentric with the axis of rotation (5) and is annular, at least in the part closest to the treatment channel (24), and an annular inlet channel (13), into which said inlet (12) for washing liquid discharges, and which is concentric with the axis of rotation (5) and is located radially outside the inlet channel (11) for the fibre suspension, the inlet channels (11, 13) being arranged to discharge into the treatment channel (24) at its inlet end (72) radially outside and adjacent to each other, so that an inner annular layer (74) of fibre suspension and an outer annular layer (75) of washing liquid that surrounds and is in direct physical contact with the layer of fibre suspension (74) are formed in the treatment channel (24), and that the rotor unit (1) is provided with a plurality of impeller vanes (27), arranged to cause the fibre suspension and the washing liquid to rotate about the axis of rotation (5) so that fibres in the fibre suspension move towards and into the outer layer of washing liquid (75) under the influence of the centripetal force.

2. An apparatus as claimed in claim 1, wherein that the inlet channel (11) for fibre suspension is defined by a first, inner wall element (14) that forms part of the rotor unit (1) and is concentric with the axis of rotation (5) and a second, outer wall element (15) that is concentric with the axis of rotation (5) and located radially outside the first, inner wall element (14) of the inlet section (2), and that the inlet (10) for fibre suspension is tangentially connected to its inlet channel (11), thereby causing the fibre suspension to assume a helical movement path through the annular inlet channel (11) and in a direction about the axis of rotation (5) corresponding to the direction of rotation of the rotor unit (1).

3. An apparatus as claimed in claim 1, wherein the outlet section (4) comprises a first, annular connection channel (20) for the reject, defined by inner and outer wall elements (21, 22) that both form part of the rotor unit (1) and are concentric with the axis of rotation (5), which connection channel (20) has a pre-determined radial extension, the treatment channel (24) being connected to said connection channel (20) so that the reject (28) is continuously removed through the connection channel (20), and a second, annular connection channel (30) for the accept located radially outside said first connection channel (20), the accept (29) being discharged through said second connection channel (30).

4. An apparatus as claimed in claim 1, wherein the impeller vanes (27) are arranged to influence the fibre suspension so that the same obtains or maintains a helical movement path through the annular treatment channel (24).

5. An apparatus as claimed in claim 2, wherein that the inlet channel (13) for washing liquid is defined by inner and outer concentric wall elements (15, 47) and the inlet (12) for washing liquid is tangentially connected to its inlet channel (13), thereby causing the washing liquid to assume a helical movement path through the annular inlet channel (13) and in the same direction as the fibre suspension.

6. An apparatus as claimed in claim 1, wherein the treatment channel (24) has a constant through-flow area.

7. An apparatus as claimed in claim 6, wherein the treatment channel (24) extends parallel with the axis of rotation (5).

8. An apparatus as claimed in claim 6, wherein the outer wall element of the treatment channel is conical with its diameter increasing towards the outlet section and in that the through-flow area increases in the direction towards the outlet section.

9. An apparatus as claimed in claim 1, wherein that the treatment channel (124) is conical with its diameter increasing in the direction towards the outlet section (104).

10. An apparatus as claimed in claim 9, wherein it comprises a device for regulating the consistency of the accept, the apparatus comprising a transit section (214), located between the treatment section (103) and the outlet section (104) and constituting a conical extension of the treatment section (103), which control device comprises one or two annular partitions (215, 216) that are arranged in a conical space (217) in the transit section (214).

11. An apparatus as claimed in claim 10, wherein the outer wall element of the outlet channel for the reject comprises a cylindrical plate part and a conical plate part, which form said partition, and in that the control device comprises an actuator that is connected to the cylindrical plate part for axial movement of the same to adjust the radial position of the conical plate part in said space relative to the inner and outer wall elements that define said space.

12. An apparatus as claimed in claim 10, wherein each of the two outer wall elements (190, 191) of the outlet channels (187, 188) for the two rejects comprises a cylindrical plate part and a conical plate part (215, 216), which conical plate parts form said two partitions, the two plate parts (215, 216) being set in pre-determined fixed radial positions or adjustable by means of individual actuators (222, 221), and in that the conical plate part (216) situated closest to the accept (129*a*) is shorter than the other conical plate part (215) so that a thickening zone is formed upstream of the shorter conical plate part (216).

13. An apparatus as claimed in claim 1, wherein the outer wall elements defining the treatment channel and nearby parts of the inlet and outlet channels for washing liquid and accept, respectively, are movably arranged and form part of the rotor unit.

14. An apparatus as claimed in claim 1, wherein the outer wall elements defining the treatment channel and nearby parts of the inlet and outlet channels for washing liquid and accept, respectively, are stationary.

15. An apparatus as claimed in claim 14, wherein at least one helical vane is rigidly arranged on the inside of said wall elements and extends in a helix from the inlet section to the outlet section to provide a feeder-effect for the rotating material.

16. An apparatus as claimed in claim 15, wherein the helical vane has a height of 2 mm.

* * * * *

UNITED STATES PATENT AND TRADEMARK OFFICE

CERTIFICATE OF CORRECTION

PATENT NO. : 6,946,072 B2
APPLICATION NO. : 10/399972
DATED : September 20, 2005
INVENTOR(S) : Ekholm et al.

It is certified that error appears in the above-identified patent and that said Letters Patent is hereby corrected as shown below:

Title page, Item [57]

Abstract, line 7, after “channel” insert --to--.

Column 1; line 6, delete “designed” and insert --designated--.

Column 7, line 44, delete “ill” and insert --111--.

Column 11, line 46, delete “that”.

Column 11, line 48, delete “that”.

Claim 1, Column 11, line 51, delete “that”.

Claim 1, Column 12, line 1, delete “that”.

Claim 2, Column 12, line 8, delete “that”.

Claim 2, Column 12, line 17, delete “that”.

Claim 5, Column 12, line 43, delete “that”.

Claim 9, Column 12, line 60, delete “that”.

Signed and Sealed this

Thirteenth Day of March, 2007

JON W. DUDAS
*Director of the United States Patent and Trademark Office*